US007484913B2

(12) United States Patent
Shotton et al.

(10) Patent No.: US 7,484,913 B2
(45) Date of Patent: Feb. 3, 2009

(54) PLACING ELEMENTS IN PILES

(75) Inventors: Peter Gilbert Shotton, Bucks (GB); Ronald Peter Payne, Iver (GB)

(73) Assignee: Cementation Foundations Skanska Limited, Hertfordshire (GB)

( * ) Notice: Subject to any disclaimer, the term of this patent is extended or adjusted under 35 U.S.C. 154(b) by 0 days.

(21) Appl. No.: 10/549,362

(22) PCT Filed: Mar. 8, 2004

(86) PCT No.: PCT/GB2004/000951

§ 371 (c)(1),
(2), (4) Date: Jun. 22, 2006

(87) PCT Pub. No.: WO2004/081297

PCT Pub. Date: Sep. 23, 2004

(65) Prior Publication Data

US 2006/0233617 A1 Oct. 19, 2006

(30) Foreign Application Priority Data

Mar. 14, 2003 (GB) ..... 0305898.9

(51) Int. Cl.
*E02D 13/04* (2006.01)

(52) U.S. Cl. ..... 405/239; 405/232; 248/545; 33/544

(58) Field of Classification Search ..... 405/239, 405/232, 244; 248/545; 33/544
See application file for complete search history.

(56) References Cited

U.S. PATENT DOCUMENTS

| | | | | |
|---|---|---|---|---|
| 1,549,168 A | | 8/1925 | Townsend | 277/331 |
| 1,822,550 A | * | 9/1931 | Thornley | 405/239 |
| 4,627,170 A | * | 12/1986 | McKechnie | 33/645 |
| 5,108,068 A | | 4/1992 | Gingras | 248/545 |

FOREIGN PATENT DOCUMENTS

EP 0 302 707 A1 2/1988

OTHER PUBLICATIONS

Patent Abstracts of Japan Publication No. 60141924 Date of Publication of Application: Jul. 27, 1985.

* cited by examiner

*Primary Examiner*—Tara L. Mayo
(74) *Attorney, Agent, or Firm*—Browdy and Neimark, P.L.L.C.

(57) ABSTRACT

The present application relates to an apparatus and method for placing an element (14), such as a steel column or concrete section, into a pile shaft (1) during top-down construction techniques. The apparatus is provided with an upper and lower positioning means (2, 3) which allow the plan position of the element at upper and lower levels respectively to be adjusted.

17 Claims, 3 Drawing Sheets

PLACING ELEMENTS IN PILES

BACKGROUND OF THE INVENTION

1. Technical Field of the Invention

The present invention relates to the construction of structures below ground by means of a technique known as "top-down" construction. In particular, the present invention relates to methods and apparatus for placing and positioning an element, such as a steel section or stanchion, within a pile shaft. Subsequently the element, which is generally positioned vertically above a load bearing pile, may be used to support loads from an above ground structure and to transmit load from ground level to the head of a load bearing pile.

2. Prior Art

Briefly, top-down construction involves the following steps:

i) construction of a perimeter wall which is installed from the prevailing ground level;

ii) installation of load-bearing piles within the curtilage of the perimeter wall. To construct each load bearing pile, a pile shaft of required depth is excavated and may be partially filled with concrete or grout. If the shaft is partially filled at this stage, the concrete of the pile is terminated at a distance below ground that generally corresponds to the level of the (future) basement slab;

iii) insertion and positioning of an element, which may be a steel column, hollow steel section, precast concrete, or any suitable member, into the 'empty' bore of the pile shaft, above the level of the concrete or "pile head". The element is designed to transmit load from ground level to the pile head. Generally the requirement is for the element to be positioned vertically, although other orientation requirements may be required for specific applications;

iv) Once the element has been positioned within the bore, it is either lowered onto the top of the set concrete in the pile, so that load transmission between the element and the pile is by end-bearing onto the concrete head, or it is plunged some distance into the concrete to become embedded in the pile before it sets.

As an alternative to the above method, it is possible for the element to be positioned within the excavated bore shaft before any concrete is placed. Once the element has been positioned within the shaft, concrete is placed to the base of the excavated shaft by means of a concrete supply pipe, and the bore filled to the required depth.

Several methods have been used in the past for positioning an element in a pile shaft during top-down construction techniques. For example, during the construction of a cast in place pile, a shaft lining tube of steel or reinforced concrete was installed and the bore was then partially filled with concrete. Once the concrete had set it was necessary for an operative to be lowered into the casing in order to clean the concrete surface and to fix a base plate or similar device to the head of the concrete. The element was then lowered into position and fixed to the base plate by the operative using surveying techniques to adjust the plan position of the element. Generally, the casing which was installed to ensure safety during the manned descent was left in place. The cost of the casings and the safety measures taken meant that the costs involved in the operation were substantial.

More recently, a variety of tools have been developed which allow the element to be positioned remotely, i.e. from ground level, by means of mechanical, electrical or hydraulic drive means.

When positioning an element within a bore hole it is important to be able to monitor and/or adjust the position of the element at or close to ground level, and also to have a knowledge of the position of the element at a lower level in the pile shaft, preferably at or near the head of the (future) concrete pile.

In EP 0302707, an apparatus for positioning a column in an underground pile shaft is described which comprises a locating frame having at least one pair of adjustable guide frames at either end of the frame. The frame is placed into a borehole so as to define an interior space through which the element is lowered, and is braced against the inner wall of a temporary casing which lines the pile shaft. The guide frames are remotely adjustable and can be operated to locate the column at that level. Once the guide frame at the upper level has been adjusted, the guide frame at the lower level is also adjusted so as to adjust the plan position of the column at the lower level.

There are a number of problems which have been encountered with the locating device described in EP 0302707. Firstly, the frames are inconvenient to store or handle due to their weight and size. Furthermore, the frame requires a temporary casing to be inserted into the bore to a depth of at least the length of the frame. The temporary casing is cumbersome and the process of installing it often time consuming.

OBJECT AND SUMMARY OF THE INVENTION

According to one aspect of the present invention there is provided an apparatus for positioning an element in a borehole, the apparatus comprising an upper positioning means and a lower positioning means for adjusting the plan position of the element at upper and lower levels respectively, wherein the positioning means are joined by means of an connection having an adjustable length.

Accordingly, the present invention allows the upper and lower positioning means to be joined by means of a variable length connection such as wire ropes, chains, link arms or the like. A variable length connection comprising telescopic arms is also envisaged. Such an embodiment would advantageously comprise at least two downwardly protruding arms provided on the upper positioning means, which are received by at least two upwardly protruding conduits provided on the lower positioning means, or visa versa. The arms may then be telescopically received within the conduits so that the distance between the upper and lower positioning means may be adjusted from a maximum distance to a minimum distance. A number of latches, bolts or the like are provided such that the length of the telescopic connection can be reliably secured.

Therefore, the present invention allows the apparatus to be adjusted to suit the specific requirements of a particular operation such that the lower positioning means is located at or near the (future) pile head. Embodiments of the present invention therefore allow columns to be positioned at greater depths than were previously possible with known positioning apparatus. The apparatus of the present invention is also advantageous in that it may be more easily stored and transported, since the connection between the upper and lower positioning means may be shortened to a more manageable length. Advantageously, the connection may be removed from the apparatus altogether when it is not in use, so that it may require less storage/transportation space.

Preferably, the upper and/or the lower positioning means have a plurality of locking rams or jacks which enable the orientation of the apparatus to be braced and secured in place within the bore. The locking rams may be arranged as two orthogonal pairs, or as 3 or 5 rams spaced at substantially equal distances around the bore. In many instances it is preferable that a temporary shaft lining tube or casing is lowered into at least the upper region of the bore hole, prior to inserting the apparatus into the bore, so that the locking rams of at least the upper positioning means can be braced against the temporary casing. Dowels fitted to the temporary tube/casing allow the orientation of the upper positioning means within the bore to be fixed.

Furthermore, by providing the lower positioning means with locking rams having bracing plates, the lower positioning means may be located at some distance below the toe of a temporary casing positioned within the bore, i.e. in the lower uncased bore. The bracing plates allow the force exerted by the locking rams on the surrounding bore to be spread over a greater surface area, so as to alleviate damage to the continuity of the bore. This allows the temporary casing to be considerably shorter than was usually necessary when using the prior art tool.

According to a second aspect of the present invention there is provided a method of positioning an element in a borehole, the method comprising the steps of:

i) placing into the borehole an apparatus comprising an upper positioning means and a lower positioning means for adjusting the plan position of the element at upper and lower levels respectively, the positioning means being joined by means of a connection having an adjustable length;

ii) lowering the element into the borehole within an interior space defined by the apparatus; and iii) adjusting the upper and lower positioning means to achieve the desired plan position of the element at the upper and lower levels respectively.

In a preferred embodiment of the present invention, the upper and lower positioning means each comprise a frame that defines an interior space which, when placed inside a borehole for use, extends along the longitudinal axis of the borehole. An element can then be passed through the interior space of the upper positioning means and extending down the borehole into the interior space of the lower positioning means. The upper and lower positioning means are provided with a guide means for steering or adjusting the plan position of an element within the interior space. In preferred embodiments, the guide means comprises a first and second pair of rollers which are moveable in mutually orthogonal directions across the horizontal plane of the interior space. The movement of the rollers may be by means of mechanical electrical or hydraulic drive means.

Embodiments of the present invention are also envisaged in which a plurality of discrete element sections are positioned within the bore, each element section being positioned and then connected to the previously positioned section until the appropriate upper level has been achieved.

Locating the element at or close to ground level is relatively straightforward and can be accomplished by means of known surveying techniques. However, accurately determining and adjusting the position of the element at a location below ground has been found to present a number of difficulties, primarily because of tolerances, such as "bow", which are inherent in almost all elements. Due to the length of the element and the fact that it is unlikely to be precisely straight, it is not sufficient to use a spirit level at or near ground level to measure the verticality over the length of the column. A number of techniques have therefore been developed which allow the plan position of the lower level to be brought into alignment with the plan position of the upper level. Therefore by aligning the plan position of an upper and lower cross section of the element, the "bow" in the element becomes irrelevant since the vertical alignment of the two predetermined levels can be assured.

For example a laser plumb device may be used which comprises a laser emitting means fitted at or near the upper level and a target positioned at or near the lower level. The centre-line of the laser and the target must both be at a fixed offset from the true centre-line of the column cross-section. Usually, both the laser and the target are fitted to the web of the column at the centre, and a remote camera or binoculars are needed to view the laser spot on the target.

An inverted plumb-bob may be used in dry bores, and/or in flooded bores (where laser plumb devices cannot operate). This comprises a pipe filled with water with a line fitted to the centre line of a base plate and having a float at the head. As with the laser system, the pipe has to be fitted at fixed offsets from the centre line of the column cross section.

Another technique which has been developed is the use of a wireline which extends along the length of the column and is fitted to brackets fixed to the column and located at or near the top and bottom thereof. An electrolevel monitor is attached to the wireline in order to determine its inclination and therefore any mis-alignment in the plan position of the upper and lower levels of the column. The electrolevel monitor, which is attached to the wire so as to be parallel to it, houses a pair of electrolevel gauges which are placed orthogonally within the housing. The electrical output of the electrolevel gauges varies as the inclination of the monitor varies and may be conveniently monitored by a suitable meter such as a digital meter. To ensure reliability, a microprocessor is used to take multiple readings and display the mean, so that the stability and integrity of the system can be evaluated. Fluctuations in the readings will indicate the presence of instabilities in the position of the element.

The wireline and electrolevel monitor technique is particularly suitable for use with the present invention, since it can monitor the alignment and therefore the plan position of two cross sections of the column at a greater depth than either of the other techniques. By attaching the wire to a bracket positioned at or near the bottom of the column, the plan position of two levels of significant distance apart can be monitored.

BRIEF DESCRIPTION OF THE DRAWINGS

For a better understanding of the present invention, and to show how the same may be carried into effect, reference will now be made, by way of example, to the accompanying drawings, in which.

DETAILED DESCRIPTION OF THE PREFERRED EMBODIMENT OF THE INVENTION

Figure 1:
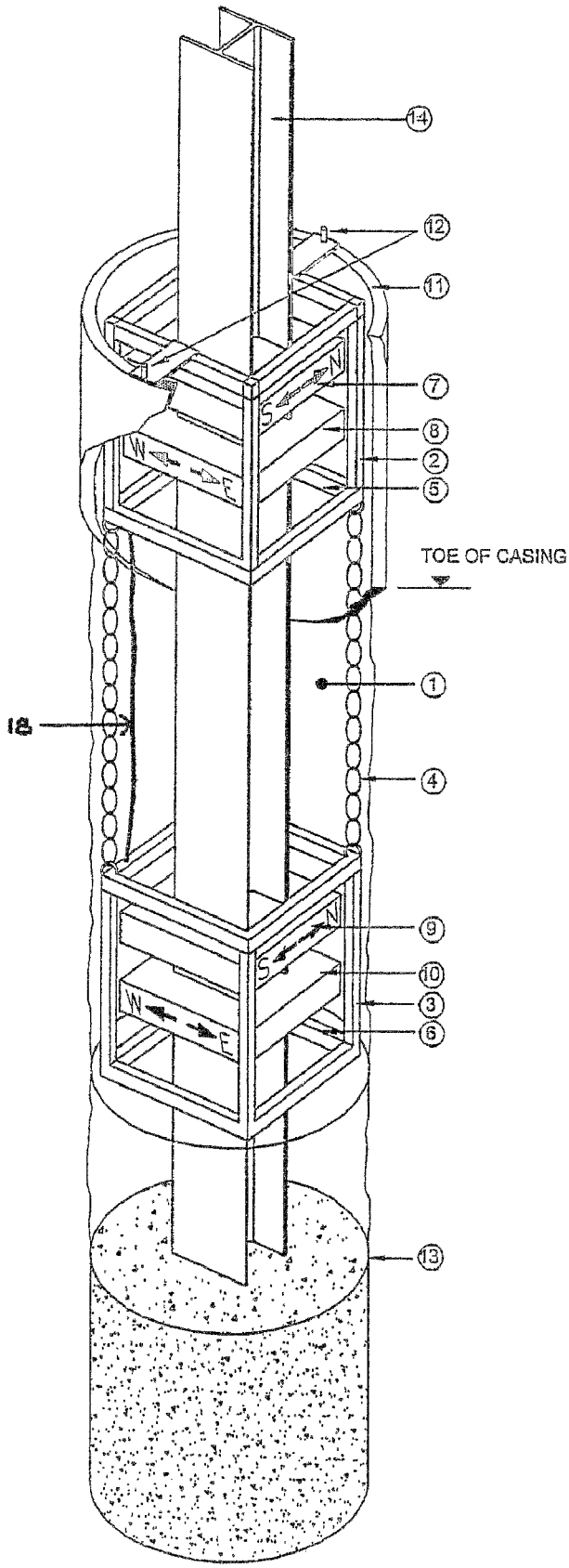
FIG. 1 shows an apparatus embodying the present invention for locating an element in a borehole.

FIG. 1 shows an apparatus embodying the present invention which has been placed within a borehole 1. The apparatus comprises an upper positioning means 2 and a lower positioning means 3 which are joined together by means of an adjustable length connection 4 in the form of a metal chain. Each of the positioning means comprises a rigid frame 5,6 which defines an interior space through which the column to be positioned may be lowered, and a pair of rollers 7, 8 and 9, 10. The rollers may be moved in mutually orthogonal directions as shown.

The present explanation describes the steps involved in positioning an element within a pile shaft, when the lower part of the bore has been partially filled with concrete. As previously discussed, techniques whereby concrete is placed to a lower level within the bore after the element has been positioned, are equally applicable to the present invention.

In use, the apparatus is lowered into the borehole 1 and the upper positioning means 2 is secured in place by means of orthogonal locking rams (not shown) which are braced against a temporary casing 11. The plan orientation of the upper positioning means 2 is secured by means of dowels 12 temporarily fixed to the top of the casing 11. The length of the connection 4 is adjusted to suit the requirements of the operation so that when lowered into the bore the lower positioning means 3 is just above the top of the pile head 13. A column 14, in the form of a steel "H" section, is lowered into the borehole 1 through the interior space defined by the upper and lower positioning means 2 and 3 respectively to a level just above the head of the concrete within the load bearing pile 13. The rollers in the upper and lower positioning means, which are conveniently moved as far apart as possible before use, are moved horizontally so as to bear on the outer edges of the column 14. They are then used to adjust the plan position of the column at the upper and lower level. Power is supplied to the lower positioning means by means of hydraulic power supply means 18. It should be appreciated however that electric power may be conveniently used as an alternative to hydraulic power.

Figure 2A:
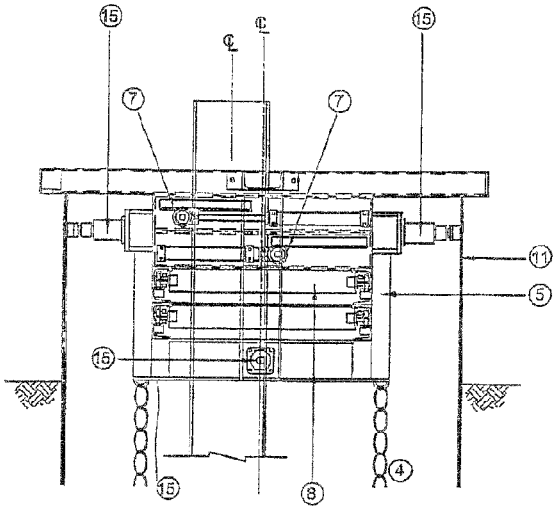
FIGS. 2A and 2B respectively show longitudinal sectional views through the upper 2C and 2D lower positioning means of the apparatus embodying the present invention shown in FIG. 1 with the column on the left and on the right.
Figure 2B:
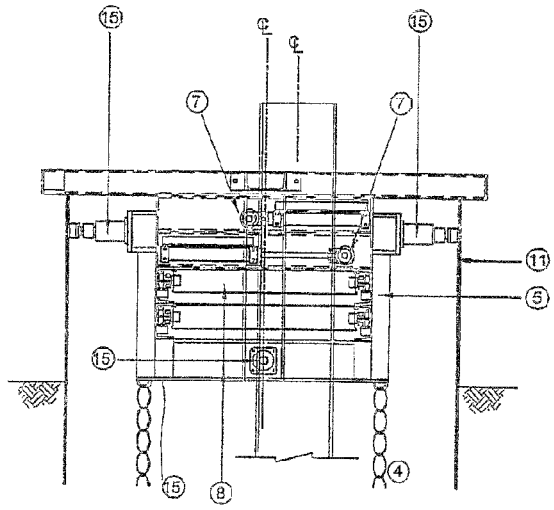
Figure 2C:
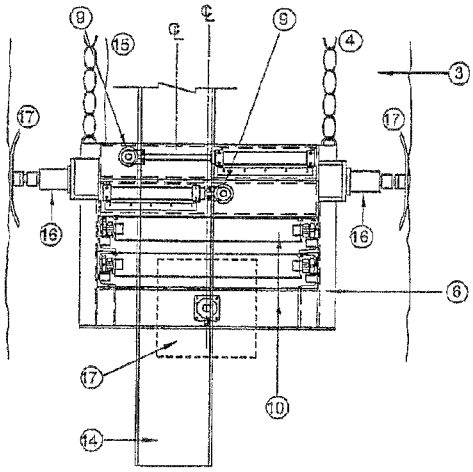
FIGS. 2C and 2D respectively show same as 2A and 2B but change "upper" to "lower" as shown above.
Figure 2D:
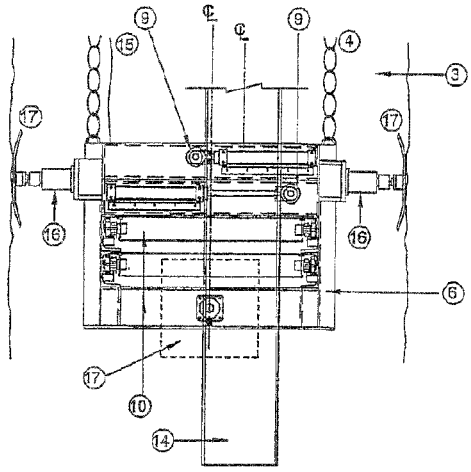

FIGS. 2A and 2B represent longitudinal sectional views through the upper and lower positioning means 2, 3 respectively of the arrangement illustrated in FIG. 1, and show in more detail the pairs of rollers in the upper positioning means (2A) and the lower positioning means (2B). Also shown in FIG. 2A are four locking rams 15 which are braced against the temporary casing and serve to secure the upper positioning means 2 at a fixed location within the temporary casing. In FIG. 2B are shown four locking rams 16 which are braced against the unlined bore and serve to secure the lower positioning means at a fixed location within the bore. The locking rams are each provided with a bracing plate 17, which protect the continuity of the unlined bore by spreading the bracing force over a larger surface area.

Figure 3:
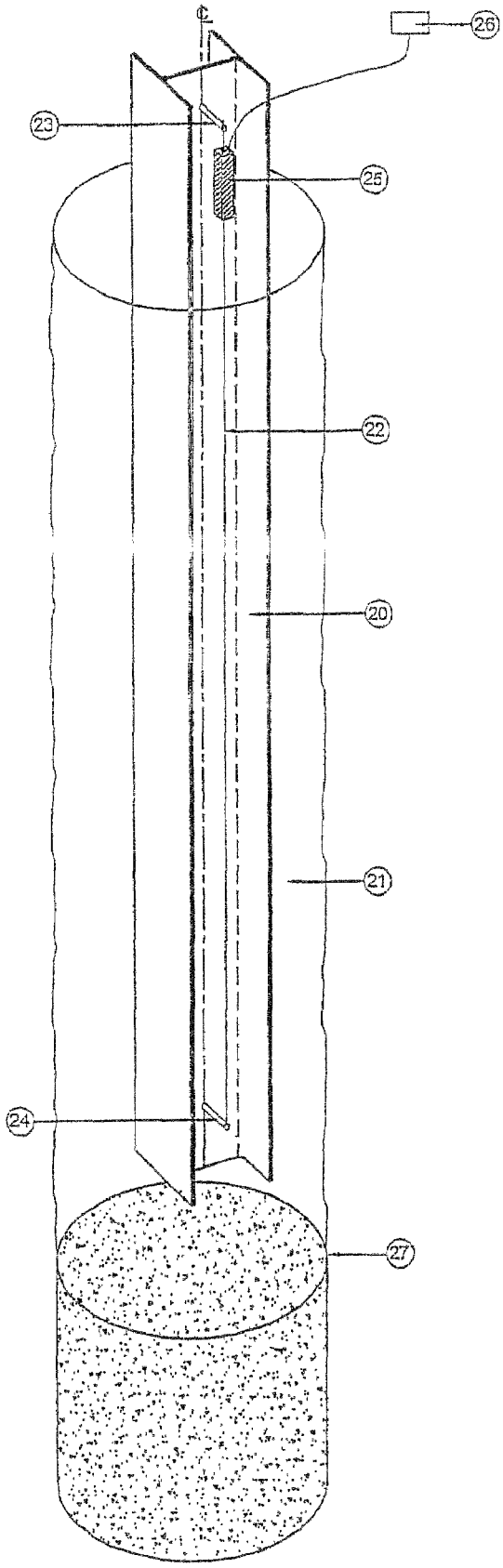
FIG. 3 shows a longitudinal element which is provided with a wireline and electrolevel monitoring system.

FIG. 3 shows a longitudinal column 20 in the form of an "H" section which is partially lowered into a bore 21 above the level of a concrete pile head 27. For reasons of simplicity the apparatus of the present invention is not shown, however the column 20 is provided with a wireline 22 which extends substantially along the length of the column and is fitted to brackets 23 and 24 located near the top and bottom of the column 20. The brackets 23 and 24 are attached at identical distances from the central and side portions of the H section, so that the wireline 22 is at a fixed identical position with respect to the top and bottom sections of the column. An electrolevel monitor 25 is attached to the upper region of the wireline in order to determine the inclination of the column 20. The electrolevel monitor, which is attached to the wire so as to be parallel to it, houses a pair of electrolevel gauges which are placed orthogonally within the housing. The electrical output of the electrolevel gauges varies as the inclination of the monitor varies and is monitored by a digital meter 26.

The invention claimed is:

1. An apparatus for positioning an element in a borehole, the apparatus comprising an upper positioning means and a lower positioning means adapted to be fixed in the borehole each having apparatus therein to adjustably move the element relative to the corresponding upper positioning means and the corresponding lower positioning means when fixed in the borehole for adjusting the plan position of the element at upper and lower levels respectively, wherein the positioning means are joined by means of a connection having an adjustable length, and wherein the apparatus defines an interior space into which, in use, the element is lowered.

2. An apparatus as claimed in claim 1, wherein the upper and lower positioning means each comprise a frame, the frames defining the interior space into which, in use, the element is lowered.

3. An apparatus as claimed in claim 2, wherein the upper and lower positioning means are provided with a guide means for adjusting the plan position of an element within the interior space.

4. An apparatus as claimed in claim 1, wherein the guide means comprises a first and a second pair of rollers which are moveable in mutually orthogonal directions across the interior space.

5. An apparatus as claimed in claim 1, wherein the connection comprises wire ropes.

6. An apparatus as claimed in claim 1, wherein the connection comprises chains.

7. An apparatus as claimed in claim 1, wherein the connection comprises link arms.

8. An apparatus as claimed in claim 1, wherein the connection comprises a pair of arms provided on one of the positioning means which are telescopically received in a pair of conduits provided on the other positioning means.

9. A method of positioning an element in a borehole, the method comprising the steps of:

i) fixing into the borehole an upper positioning means and a lower positioning means each respectively having adjustment apparatus for moving the plan position of the element relative to the corresponding upper positioning means or lower positioning means and corresponding at upper and lower levels respectively, wherein the positioning means are joined by means of a connection having an adjustable length;

ii) lowering the element into an interior space defined by the connection to a required depth within the borehole; and ii) adjusting the adjustment apparatus upper and lower positioning means to achieve the desired plan position and orientation of the element.

10. A method as claimed in claim 9, wherein before placing the apparatus into the borehole, a temporary shaft lining tube is placed within the borehole.

11. A method as claimed in claim 10, wherein the orientation of the apparatus is fixed relative to the temporary casing by means of a plurality of locking rams.

12. An apparatus for positioning an element in a borehole, the apparatus comprising an upper positioning means formed as an upper frame and a lower positioning means formed as a lower frame adapted to be fixed in the borehole, each said frame having guide means therein to adjustably move the element relative to the corresponding upper frame and the corresponding lower frame when fixed in the borehole for respectively adjusting the plan position of the element at upper and lower levels, wherein the upper and lower frames are joined by means of a connection having an adjustable length, and wherein the connected upper and lower frames define an interior space into which, in use, the element is lowered.

13. An apparatus as claimed in claim 12, wherein the guide means comprises a first and a second pair of rollers which are moveable in mutually orthogonal directions across the interior space.

14. An apparatus as claimed in claim 12, wherein the connection comprises wire ropes.

15. An apparatus as claimed in claim 12, wherein the connection comprises chains.

16. An apparatus as claimed in claim 12, wherein the connection comprises link arms.

17. An apparatus as claimed in claim 12, wherein the connection comprises a pair of arms provided on one of the positioning means which are telescopically received in a pair of conduits provided on the other positioning means.

* * * * *